US005431294A

United States Patent [19]

Stottmann et al.

[11] Patent Number: 5,431,294

[45] Date of Patent: Jul. 11, 1995

[54] MODULAR FLATWARE BASKET ASSEMBLY

[75] Inventors: Richard L. Stottmann, Harrods Creek; Thomas J. Binzer, Prospect, both of Ky.

[73] Assignee: General Electric Company, Louisville, Ky.

[21] Appl. No.: 305,508

[22] Filed: Sep. 13, 1994

Related U.S. Application Data

[63] Continuation of Ser. No. 123,228, Sep. 20, 1993, abandoned.

[51] Int. Cl.[6] ..... B65D 21/028

[52] U.S. Cl. ..... 220/23.4; 220/488; 220/525; 220/759; 211/41

[58] Field of Search ..... 16/114 R; 211/41, 181; 134/201; 220/23.4, 23.83, 488, 525, 526, 752, 756, 757, 759, 760, 769, 487, 486; 312/228.1, 348.3

[56] References Cited

U.S. PATENT DOCUMENTS

| | | | |
|---|---|---|---|
| 166,102 | 7/1875 | Hennaman et al. | 220/525 |
| 1,275,695 | 8/1918 | Iverson | 220/756 |
| 2,589,423 | 3/1952 | Nadolsky et al. | 220/760 |
| 3,050,073 | 8/1962 | McMillan | 211/181 |
| 3,131,829 | 5/1964 | Masser | 220/23.4 |
| 3,529,742 | 9/1970 | Cumming | 220/69 |
| 3,861,733 | 1/1975 | Vander Mey | 220/760 |
| 3,935,958 | 2/1976 | Frangos | 220/488 |
| 4,094,431 | 6/1978 | Wheeler | 220/23.4 |
| 4,301,942 | 11/1981 | Kupperman et al. | 220/525 |
| 4,498,594 | 2/1985 | Elder | 220/488 |
| 4,610,368 | 9/1986 | Tsutomu Hasebe | 220/19 |
| 4,826,263 | 5/1989 | Speraw | 220/23.4 |
| 5,184,744 | 2/1993 | Paulison | 220/23.4 |
| 5,249,590 | 10/1993 | Jacobus et al. | 211/41 |
| 5,351,837 | 10/1994 | Smith | 220/488 |

*Primary Examiner*—Stephen J. Castellano
*Attorney, Agent, or Firm*—H. Neil Houser

[57] ABSTRACT

A flatware basket for use in a modular basket assembly in a dishwasher includes a bottom wall bounded by upstanding, spaced apart side walls joined by end walls. A first upstanding cross wall joins the side walls midway between the end walls and includes horizontal openings. A handle includes alternating, depending fingers with inwardly facing ribs. The handle is mounted on the cross wall with the fingers overlapping the cross wall and the ribs received in the cross wall openings. A cover mounted on the handle moves between a vertical position and horizontal positions on either side of the handle. Another cross wall supports the cover in one of its horizontal positions and ribs support the handle in its other horizontal position. One of the basket side walls is planar and includes key holes in predetermined locations adjacent one end of the wall and buttons spaced from the wall at corresponding positions adjacent the other end of the wall so that two of the baskets can be connected with their planar walls abutting.

13 Claims, 3 Drawing Sheets

Fig. 4
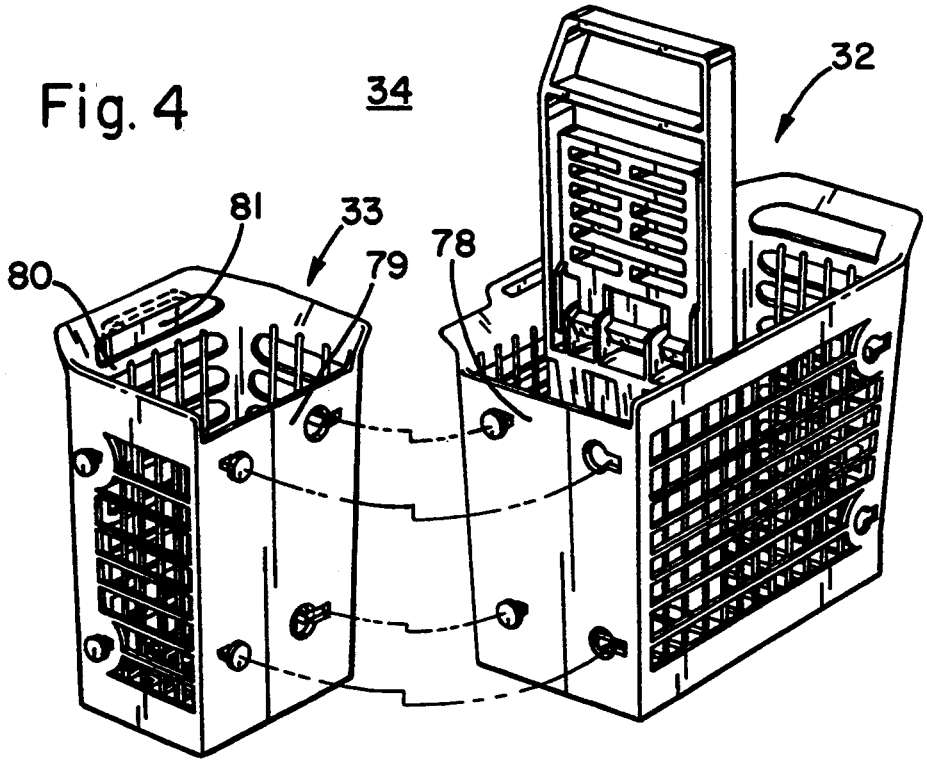
Fig. 3
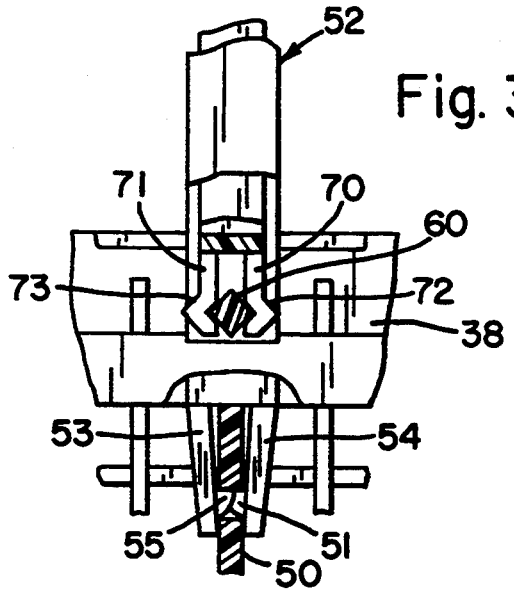
Fig. 6
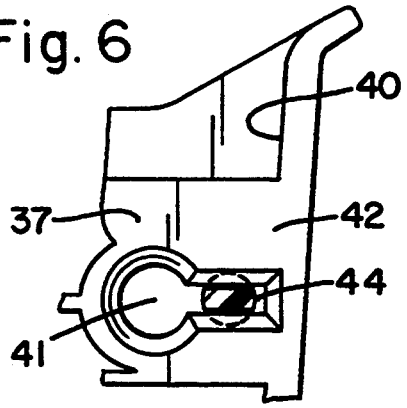
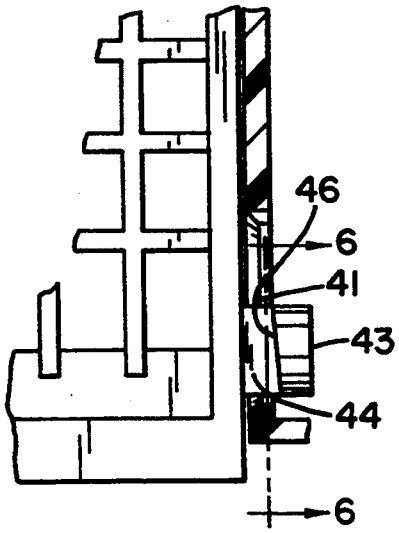
Fig. 5

MODULAR FLATWARE BASKET ASSEMBLY

This application is a continuation, of application Ser. No. 08/123,228 filed Sep. 20, 1993 now abandoned.

BACKGROUND OF THE INVENTION

Automatic domestic dishwashers, that is those designed primarily for use in the home, support various dishes and items of cookware in open racks or trays and accomplish the washing and rinsing action by spraying streams of water over the items. Typically a basket is positioned within the washing cavity to hold flatware and miscellaneous small items during the washing and rinsing operations. While the basket in some dishwashers is mounted on or is integral with the door, it is common practice to support the basket on the bottom rack. Such baskets tend to be relatively large in order to hold a significant number of knives, forks, spoons and other items. This takes up significant room in the rack and, from time to time, may interfere with optimum loading of dishes and utensils. Sometimes there are fewer flatware items than the capacity of the basket and sometimes the number and configuration of soiled dishes and utensils is such that the washing operation would be enhanced if the flatware basket were positioned in a different location, were divided into more than one component or if only part of the basket were used for that particular operation.

SUMMARY OF THE INVENTION

Therefore it is an object of the present invention to provide an improved flatware basket assembly which enhances the flexibility of the dishwasher loading.

It is another object of this invention to provide an improved flatware basket which can be divided into separate components that can be supported separately within the dish rack.

In accordance with one form of the invention there is provided a basket, for use in a flatware basket assembly for an automatic dishwasher, including a bottom wall bounded by spaced apart side and end walls forming an open top receptacle. A first vertical cross wall extends between the side walls generally midway between the end walls. A handle extends along and projects upwardly of the cross wall. A downwardly facing hook is positioned on the outside of one side wall. The other side wall is planar and includes a plurality of key holes at predetermined locations adjacent one of its ends and a corresponding plurality of buttons spaced outwardly of corresponding locations adjacent the other of its ends so that two of the baskets can be selectively connected with their planar side walls abutting.

BRIEF DESCRIPTION OF THE DRAWINGS

The above and other objects features and advantages of the present invention will become more apparent from the following description, taken in conjunction with the accompanying drawings, in which:

FIG. 3 is a fragmentary side elevation view of one of the baskets of FIG. 2, as seen along line 3—3 in FIG. 2;

FIG. 4 is a fragmentary side elevational view of two baskets connected together, illustrating the key hole and button connection;

FIG. 5 is a fragmentary plan view, partly in section, illustrating the selective connection of two component baskets; and FIG. 6 is a view as seen along line 6—6 in FIG. 5.

DETAILED DESCRIPTION OF PREFERRED EMBODIMENTS

Figure 1:
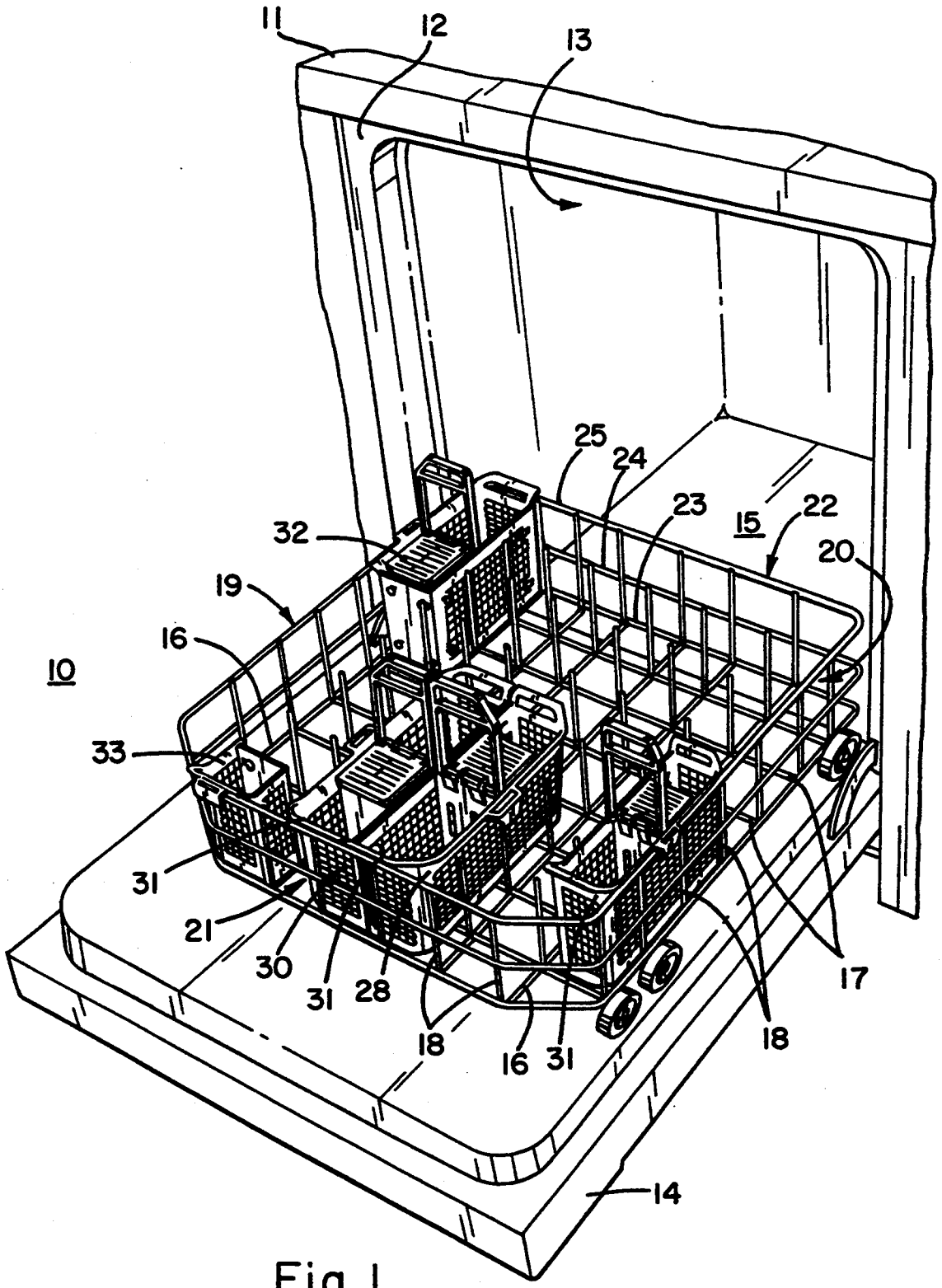
FIG. 1 is a simplified, somewhat schematic, perspective view of an under counter domestic dishwasher with the access door open to expose certain operating components and illustrating flatware baskets in accordance with certain aspects of the present invention.

Referring now to the drawings, and initially more particularly to FIG. 1, there is illustrated an under counter type automatic domestic dishwasher 10 installed in a typical kitchen cabinet 11. The dishwasher 10 includes a cabinet 12 defining a wash chamber 13. A door 14 is hinged along its lower edge to move between a horizontal position, as shown, providing access to the chamber 13 and a vertical position in which it seats against the peripheral edge of the cabinet 12 to seal the chamber 13. A lower rack 15 is movable into and out of the chamber 13 and supports dishes, glasses, utensils and other items to be washed, as is well known in the art. Typically dishwashers also include an upper rack, also moveable in to and out of the chamber 13, and various other parts and components, which are well known and have been omitted for the sake of simplicity.

The rack 15 has a reticulated or open network construction so that the wash and rinse liquid sprayed into the chamber 13 can freely impinge upon the items supported on the rack and drain back into the bottom of the chamber 13. More particularly, the bottom wall of the rack is formed of spaced apart longitudinal rods 16 joined to spaced apart lateral rods 17. The end portions of the rods 16, 17 are bent to form upwardly extending rods 18, defining enclosing lateral walls, more specifically side walls 19, 20 a front wall 21 and a rear wall 22. Bottom, center and upper horizontal rods or bands 23, 24, 25 extend around the rack and are joined to the vertical rods 18 to stiffen the side, front and rear walls 19–22. A network of spaced apart, vertical tines or fingers extend upwardly from the bottom wall and preferably from the junctions of the longitudinal and lateral rods 16, 17, to support dishes, utensils and other items placed in the rack. Preferably the rack 15 is formed from metal rods or heavy gauge wires which have been welded together and coated to protect the rack 15 from rusting and glass items from contacting hard metal. However, it will be understood that other rack constructions may be employed. For example, the rods, bands and tines could be molded as an unitary structure from a suitable plastic material. The tines are omitted from an area in the front center of rack 15 to provide an open space 28 to receive a composite flatware basket assembly 30. The front center location is preferable for ease of loading flatware items into the basket assembly and removing such items from the assembly. However, the clear space may be provided in some other portion of the rack if desired.

As will be explained in more detail hereafter, the composite assembly 30 is formed of two or more individual component baskets that selectively may be releasably joined or locked together or may be separated and used individually. In FIG. 1, the assembly 30 is composed of two identical baskets 31 releasably joined. For purposes of illustration, FIG. 1 also includes an individual basket 31 adjacent side wall 20, as well as an intermediate size component basket 32, adjacent side wall 19 and a small size component basket 33 adjacent front wall 21. The intermediate and small size component baskets are constructed to be releasably joined together to form a basket substantially similar to basket 31. The row of tines adjacent at least one and preferably all the lateral walls 19–22 are spaced a predetermined distance from the corresponding lateral wall so that the component baskets 31–33 will closely fit between the tines and the adjacent rack lateral wall. It will be understood that, if desired, less than all the lateral wall/tine configurations may be adapted to accept component baskets. It will be understood that assembly 30 and component baskets 31, 32 and 33 are all shown in FIG. 1 for purposes of illustration only. Normally a single basket assembly, such as 30, would be provided with a particular dishwasher. The baskets could be used as an assembly or one or more of the baskets could be used in selected individual locations in the rack 15. This provides the user with great flexibility in the use of the flatware basket.

Figure 2:
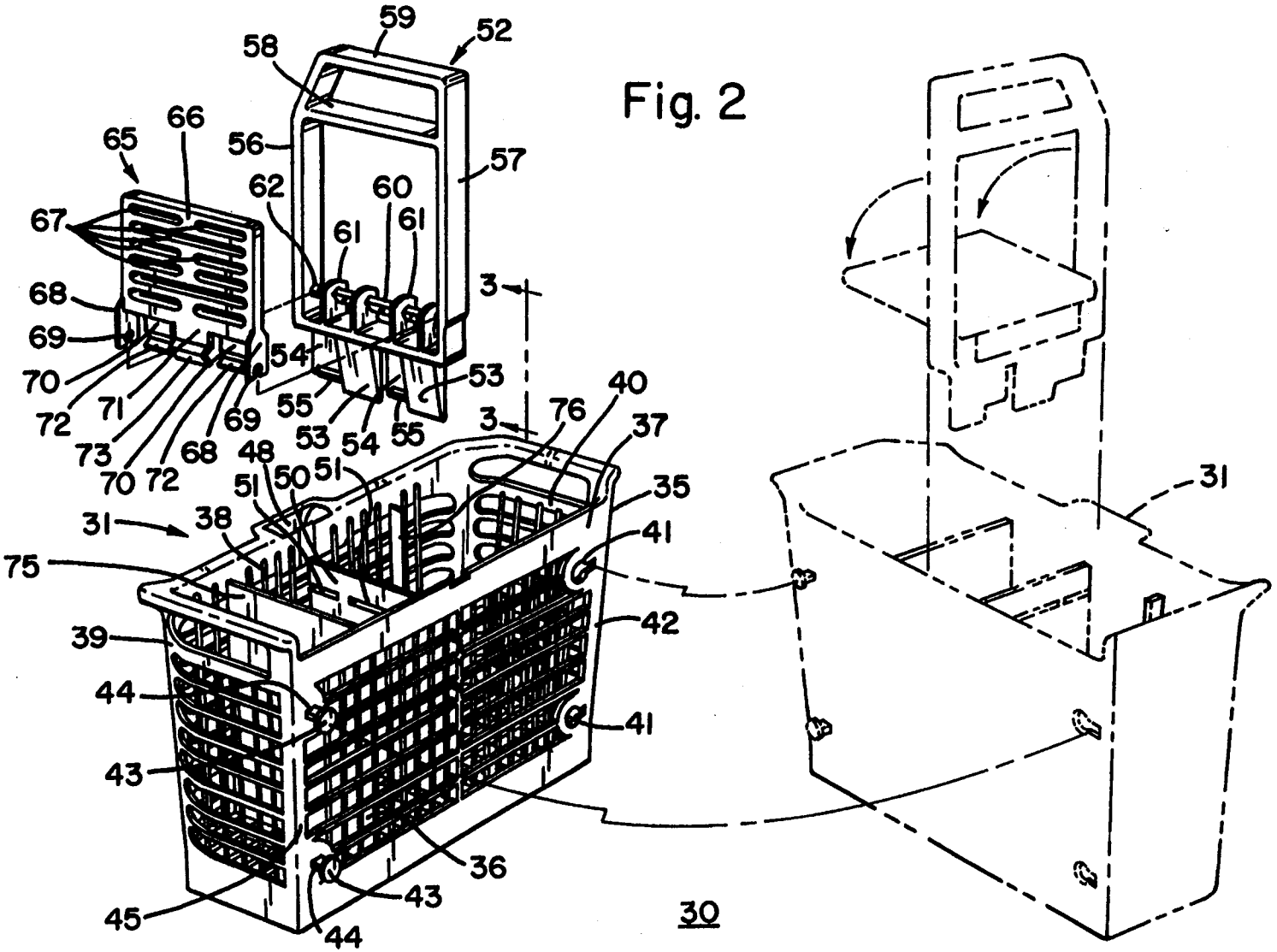
FIG. 2 is an exploded perspective view, partly in phantom, of a flatware basket assembly incorporating one embodiment of the present invention.

Referring now particularly to FIG. 2, composite basket assembly 30 is illustrated in more detail, with one component basket 31 shown in solid line and the identical companion basket 31 shown in phantom line. Conveniently each of the baskets is formed with a unitary, molded plastic body 35 including a bottom wall 36 enclosed by upwardly extending lateral walls, including side walls 37, 38 joined by end walls 39, 40. The basket 31 is essentially of a reticulated or open mesh construction so wash and rinse liquid will easily drain out. However, as illustrated, the edges and corners preferably are solid for added strength.

A pair of key hole slots 41 are formed near the upper and lower corners of the solid edge 42 at one horizontal end of the side wall 37. A pair of buttons 43 are formed at the distal ends of a pair of posts 44 extending outward adjacent the upper and lower corners of the solid edge 45 at the other horizontal end of side wall 37. Side wall 37 is planar and is perpendicular to bottom wall 36. Since the baskets 31 are identical, two baskets can be joined by inserting and seating the buttons of one basket in the corresponding key holes of the other basket. Referring particularly to FIG. 5, it will be seen that the underside of the buttons facing the side wall of the basket is canted or sloped in a direction to draw the two baskets tightly together as the buttons are fully seated in the corresponding key holes. So long as the releasable connection mechanism is compatible the individual component baskets do not have to be identical, however identicality simplifies manufacturing and parts storage for the manufacturer.

A downwardly opening hook portion 48 is spaced outwardly from the upper edge of the other side wall 38 and is positioned to engage the top band 25 of rack 15 when the basket is individually mounted adjacent one of the lateral walls of the rack. This ads to the stability of individual baskets when subjected to the streams of wash and rinse liquid sprayed into the chamber 13.

A first vertical cross wall 50 extends perpendicularly between side walls 37, 38 midway between end walls 39, 40. Preferably wall 50 projects upwardly from the bottom wall 36 to slightly below the top of the basket. Conveniently the wall 50 is substantial imperforate but includes a series of aligned, horizontal slots 51 slightly below its upper edge. A handle 52 includes a horizontal array of downwardly extending, oppositely facing fingers 53, 54. Each of the fingers includes a rib 55 facing inwardly, that is toward the opposite fingers. The handle is mounted to the basket 31 by inserting the fingers 53, 54 over opposite sides of first cross wall 50 until the ribs are seated in corresponding slots 51 (see FIG. 3). The fingers 53,54 flex as the ribs 55 slide over cross-wall 50 and then securely retain the ribs 55 in the slots 51. A pair of arms 56, 57 extend upwardly from the fingers 53, 54 and terminate in horizontal cross-members 58, 59 which form a grip for the user. Since the handles are attached across the middle of the baskets, when two baskets are joined the grips come into register and form an essentially continuous means for the user to grasp in moving the assembly.

Just above the top of fingers 53, 54 a rectangular cross section bar 60 extends between the arms 56, 57 and is supported by ribs 61. The bar 60 is oriented so that two of its diagonally opposite corners are vertically aligned and its other diagonally opposite corners are horizontally aligned. Each of the arms 56, 57 includes an inwardly projecting hub 62, axially aligned with the bar 60. A cover 65 includes a body portion 66 having several parallel elongated slots 67. Arms 68 extends from two opposite corners of the body portion and each arm includes an opening 69 adjacent its distal end. Flat fingers 70, 71 extend from the body portion between the arms 68 and include oppositely facing right angled offset portions 72, 73 at their distal ends. The offset portions are axially aligned with the openings 69. A cover 65 is mounted to a handle 52 by inserting the fingers 70, 71 on opposite sides of the bar 60 until the offset portions 72, 73 come into engagement with the bar and the hubs 62 are received in the openings 69. Thereafter the cover 65 is moveable between a generally vertical position, within the handle 52 and exposing the entire basket 31 (as seen in FIG. 4), and a generally horizontal position to either side of the handle and covering a portion of the basket 31 (as seen in the phantom line portion of FIG. 2). The fingers 70,71 urge the offset portions 72,73 into engagement with the bar 60 while flexing sufficiently to permit the cover to be moved between its positions.

The basket 31 is formed to support the cover 65 when it is in either of its generally horizontal positions. To that end a second vertical cross wall 75 extends between the basket side walls 37, 38 and is spaced from the first cross wall 50 to support the distal portion of cover body 66. On the other side of first cross wall 50 each side wall 37, 38 is formed with a vertically extending rib 76, positioned to support the distal portion of the cover body 66. Preferably the wall 75 is substantially imperforate or has openings of similar size to the lateral walls of the basket. Thus engagement of the cover 65 with wall 75 forms a chamber which conveniently can be used to wash small light items, such as baby bottle nipples and various plastic items for example, that otherwise would be displaced by the force of the liquid sprayed into the chamber 13. On the other hand the horizontal slots 67 in the cover 65 conveniently may be sized to accept items like the blades of cooking knives. When the cover is in its other horizontal position such items can be inserted through the slots and the ribs 76 will not interfere with their convenient nesting in basket 31 for optimal loading.

FIG. 4 illustrates an intermediate size component basket 32 and a small size component basket 33 which selectively can be used individually, as shown in FIG. 1, or joined or connected to form a component basket substantially like basket 31. To that end the mating end walls 78 of basket 32 and 79 of basket 33 are formed with corresponding key hole slots 41 and button 43 and post 44 arrangements. The buttons may be inserted into corresponding slots to connect or join the baskets into a composite basket corresponding to basket 31. On the other hand when the buttons and slots are disengaged the baskets can be used separately. To that end a downwardly facing hook 81 is spaced outwardly of the upper edge of the outer end wall of basket 33. The hook 81 is placed over top band 35 to secure basket 33 in place in the rack 15 when the small basket 33 is used separately.

What is claimed is:

1. An open top rack assembly for use in a dishwasher, comprising:

a rack including a bottom wall formed of a plurality of spaced apart longitudinal rods; side walls formed of a plurality of spaced apart upwardly extending rods bound by at least one circumferentially extending rod; a plurality of spaced apart tines projecting generally upwardly of the bottom wall to support items to be washed, the space between said tines providing a first, larger clear space receiving a composite flatware basket assembly and a second, smaller clear space to receive a flatware basket;

said composite flatware basket assembly comprising a pair of complementary baskets, each basket having a bottom wall and a plurality of upstanding lateral walls, said bottom and lateral walls being substantially of an open mesh construction to support flatware items while permitting flow of liquid through that basket;

each of said baskets including integral means for releasably securing one basket to another basket, said integral means of each of said one basket cooperating with said integral means of said another basket to releasably secure said baskets in a side-by-side configuration to form said composite basket assembly;

said composite basket assembly being fitted within the first clear space provided by the space between said tines and each of said baskets being sized to fit individually within the second clear space provided by the space between said tines.

2. A rack assembly as set forth in claim 1, wherein: each of said baskets further includes a handle projecting upwardly of a spaced apart pair of its lateral walls and wherein said handles are positioned to form a composite handle means for said basket assembly when said baskets are secured in their side-by-side configuration.

3. A rack assembly as set forth in claim 1, wherein;

each of said baskets has a generally rectangular cross section and said basket lateral walls include a pair of spaced apart elongated side walls joined by a pair of end walls;

said integral means is effective to secure said baskets together with predetermined ones of their side walls in engagement;

each of said baskets further includes a handle extending between and projecting upwardly of its side walls and said handles are positioned to form an essentially continuous handle means across said basket assembly when said baskets are secured in their side-by-side configuration.

4. A rack assembly as set forth in claim 3, wherein:

at least one of said baskets further includes a cover rotatably mounted to its handle and moveable between a generally vertical position exposing the top of that basket and a generally horizontal position to each side of its generally vertical position covering a different portion of that basket;

said at least one basket further includes a cross wall extending between its side walls and positioned to support said cover when said cover is in one of its generally horizontal positions; and said at least one basket also includes means for supporting said cover when it is in its other generally horizontal position.

5. A rack assembly as set forth in claim 4, wherein:

each of said baskets includes a cross wall extending between its side walls, said cross wall including a series of horizontally extending openings;

each of said handles includes a series of horizontally arrayed, alternately facing, depending fingers, and each of said fingers includes a horizontally extending, inwardly facing rib;

each of said handles being mounted to the corresponding basket with its fingers overlying the corresponding cross wall and its ribs received in corresponding ones of said series of horizontally extending openings in said corresponding cross wall.

6. A rack assembly as set forth in claim 1, wherein said integral securing means includes:

key holes formed in a lateral wall of at least one of said baskets and mating buttons integral with and spaced from a corresponding lateral wall of at least the other of said baskets and removably received in corresponding ones of said key holes in said lateral wall of said at least one of said baskets to selectively secure said baskets in a side-by-side relationship.

7. A rack assembly as set forth in claim 1, wherein: said baskets are substantially identical.

8. A rack assembly as set forth in claim 1, wherein: at least one of said baskets is formed of two smaller baskets releasably joined together.

9. A rack assembly as set forth in claim 1, wherein:

at least one of said baskets has a generally rectangular cross section and said lateral walls of said at least one basket include a pair of spaced apart elongated side walls joined by a pair of end walls;

a first vertical cross wall extends between said side walls of said at least one basket at a position generally midway between said end walls of that basket;

a handle extends upwardly of and projects along said first cross wall;

a downwardly opening hook means is positioned on the outside of one of said side walls of said at least one basket;

said integral means for releasably securing said at least one basket to another basket is integral with the other of said side walls of said at least one basket.

10. A rack assembly as set forth in claim 9, wherein:

said at least one basket further includes a cover rotatably mounted to said handle and moveable between a generally upright position exposing the top of that basket and a generally horizontal position to one side of said handle for covering a portion of that basket;

a second vertical wall extends between said side walls of said at least one basket on said one side of said handle to a level to support said cover when it is in its generally horizontal position.

11. A rack assembly as set forth in claim 10, wherein:

said handle also is movable between its generally upright position and a generally horizontal position to the other side of said handle for covering another portion of said at least one basket;

support means extends into said at least one basket on said other side of said handle at a level to support said cover when it is in its other generally horizontal position.

12. A rack assembly as set forth in claim 9, wherein:

said first cross wall includes a series of horizontally extending openings;

said handle includes a series of horizontally arrayed, alternately facing, depending fingers; each of said fingers including a horizontally extending, inwardly facing rib;

said handle being mounted on said first cross wall with said fingers overlying said first cross wall and said ribs received in said openings.

13. A rack assembly as set forth in claim 9, wherein:

said integral means includes a plurality of key holes formed in predetermined locations adjacent one end of said other side wall and a corresponding plurality of buttons mounted to and positioned outward of said other side wall at predetermined locations adjacent the other end of said other side wall for releasably connecting said at least one basket to another correspondingly formed basket.

* * * * *